US005910362A

United States Patent [19]

Aratake et al.

[11] Patent Number: 5,910,362

[45] Date of Patent: Jun. 8, 1999

[54] POLYOLEFIN FIBER AND NON-WOVEN FABRIC PRODUCED BY USING THE SAME

[75] Inventors: Kazuhiko Aratake, Osaka; Masahiko Taniguchi, Chiba; Hidemi Ito, Shiga, all of Japan

[73] Assignee: Chisso Corporation, Osaka, Japan

[21] Appl. No.: 08/930,673

[22] PCT Filed: Apr. 24, 1997

[86] PCT No.: PCT/JP97/01429

§ 371 Date: Sep. 30, 1997

§ 102(e) Date: Sep. 30, 1997

[87] PCT Pub. No.: WO97/40216

PCT Pub. Date: Oct. 30, 1997

[30] Foreign Application Priority Data

Apr. 25, 1996 [JP] Japan ..... 8-104867

[51] Int. Cl.[6] ..... D02G 3/00

[52] U.S. Cl. ..... 428/364; 428/395; 428/409

[58] Field of Search ..... 428/364, 395; 442/409

[56] References Cited

U.S. PATENT DOCUMENTS

| | | | |
|---|---|---|---|
| 5,281,378 | 1/1994 | Kozulla | 264/83 |
| 5,318,735 | 6/1994 | Kozulla | 264/83 |
| 5,431,994 | 7/1995 | Kozulla | 428/286 |

*Primary Examiner*—Newton Edwards
*Attorney, Agent, or Firm*—Wenderoth, Lind & Ponack, L.L.P.

[57] ABSTRACT

Polyolefin fibers are disclosed having a surface portion of a low-orientation domain and an inner portion of a high-orientation domain, the orientation parameter, as measured by the Raman spectroscopy, of the low orientation domain is smaller than that of the high orientation domain by 2.2 or more, but less than 8.0. By using the polyolefin fibers, non-woven fabrics having a high strength and excellent hand feeling can be provided. Further, since the fibers can be processed into nonwoven fabrics at a wide range of processing temperature when a point bonding method is used, non-woven fabrics having stabilized qualities can be prepared.

7 Claims, 2 Drawing Sheets

MEASURING POINTS IN RAMAN SPECTROSCOPY

POLYOLEFIN FIBER AND NON-WOVEN FABRIC PRODUCED BY USING THE SAME

TECHNICAL FIELD

The present invention relates to a polyolefin fiber and a non-woven fabric produced by using the fiber. More specifically, the present invention relates to a polyolefin fiber which can be processed by a heat-melt-adhesion into a non-woven fabric having a high strength and excellent hand feeling, and relates to a non-woven fabric produced by using the fiber.

BACKGROUND ART

Since non-woven fabrics produced by using heat-melt-adhesive fibers do not contain a chemical binder such as an adhesive, the fabrics are excellent in safety, and thus they have widely been used. Since polyolefin type non-woven fabrics are excellent in performances and economy in particular, they have been used in many fields such as operating gowns, medical supplies such as paper diapers and sanitary napkins, civil engineering materials, farming materials, and industrial materials. Method for producing heat-melt-adhesion type non-woven fabrics are broadly divided into a through-air method using heated air and a heated-roll method. Whereas the through-air method can be applied to polyethylene/polypropylene composite fibers, it has a problem that productivity is low since processing speed is slow compared with the heated-roll method. On the other hand, the heated-roll method has an advantage of being excellent in the productivity since the processing speed is high. As fibers suitable for the heated-roll method, polypropylene fibers comprising an ethylene-propylene random copolymer having a softening point of lower than 132° C. and containing a prescribed amount of ethylene unit are proposed in Laid-open Japanese Patent Publication No. Sho 62-156310. However, the fibers have such defects that the hand feeling of non-woven fabrics produced by using the fibers is poor and that the range of fiber processing temperature at which non-woven fabrics having a strength sufficient to stand practical uses can be produced is extremely narrow. Non-woven fabrics comprising polypropylene fibers of a low stereo-regularity having a specific isotactic pentad fraction are proposed in Laid-open Japanese Patent Publication No. Hei 2-112456. Whereas the non-woven fabrics have a good hand feeling, their strength is not satisfactory. Whereas polypropylene fibers having a specific compound blended therein are proposed in Laid-open Japanese Patent Publication No. Hei 2-264012, the fibers are not sufficient either in hand feeling and in strength. A method for producing non-woven fabrics in which fibers are strongly heat-melt-adhered, and thus having a high strength, by using fibers which have three domains (i.e., surface domain, intermediate domain, and inner domain) in which molecular weight of the polymer successively increases from the surface portion toward the core portion, formed by oxidative-deterioration from the surface portion toward the core portion of the fiber is disclosed in Laid-open Japanese Patent Publication No. Hei 4-228666. Further, a fact that non-woven fabrics in which filaments or short fibers are strongly heat-melt-adhered can be obtained by using filaments or short fibers having a skin-core structure is disclosed in Laid-open Japanese Patent Publication No. Hei 7-11508. However, these non-woven fabrics can not be said to be satisfactory from the viewpoint of the balance of the strength with the hand feeling of non-woven fabrics.

DISCLOSURE OF THE INVENTION

As described above, it is impossible to produce non-woven fabrics which satisfy both the strength and hand feeling, through conventional technology. Thus, an object of the present invention is to solve the problems described above and to provide polyolefin fibers for preparing non-woven fabrics having a high strength and excellent hand feeling.

The present invention has aspects or embodiments as follows:

(1) A polyolefin fiber comprising a surface portion of a low-orientation domain and an inner portion of a high-orientation domain, the orientation parameter, as measured by the Raman spectroscopy, of the low orientation domain is smaller than that of the high orientation domain by 2.2 or more, but less than 8.0.

(2) The polyolefin fiber recited in the aspect (1) described above wherein the ratio of the area of the cross-section of the low orientation domain to the area of whole cross-section of the fiber (area percentage) is 5% or more, but less than 40%.

(3) The polyolefin fiber recited in the aspect (1) or (2) described above wherein the polyolefin fiber is polypropylene fiber.

(4) The polyolefin fiber recited in any one of the aspects (1) to (3) described above wherein polypropylene of the polyolefin fiber is polypropylene polymerized by using a Ziegler-Natta catalyst or a metallocene catalyst.

(5) A non-woven fabric produced by heat-melt-adhering an agglomerate of the polyolefin fiber, recited in any one of the aspects (1) to (4) described above, by a point bonding method.

BEST MODE FOR CARRYING OUT THE INVENTION

In the present invention, the "orientation parameter" is defined by the ratio ($R\|/R\perp$) of relative strengths $R\|$ and $R\perp$ of lights having a specific wave length scattered with the molecules at a measuring point in a fiber determined by the Raman spectroscopy (method of laser Raman microprobe). The orientation parameter is determined for many measuring points at a surface portion, center portion, or the surface portion at the opposite side in a section parallel to the length wise direction of the fiber and crossing the center of cross-section of the fiber. The $R\|/R\perp$ (ratio of R in both directions of polarization) is interrelated with orientation degree, and the larger this value is, the higher the orientation degree of molecules is. In the equation $R\|/R\perp$, $R\|$ is the relative strength ($I_{810}/I_{840}$) of scattered lights at the wave length of 810 $cm^{-1}$ or 840 $cm^{-1}$ determined in a light polarization arrangement parallel to the fiber axis, and $R\perp$ is the relative strength ($I_{810}/I_{840}$) of scattered lights at the wave length of 810 $cm^{-1}$ or 840 $cm^{-1}$ determined in a light polarization arrangement perpendicular to the fiber axis.

Figure 1:
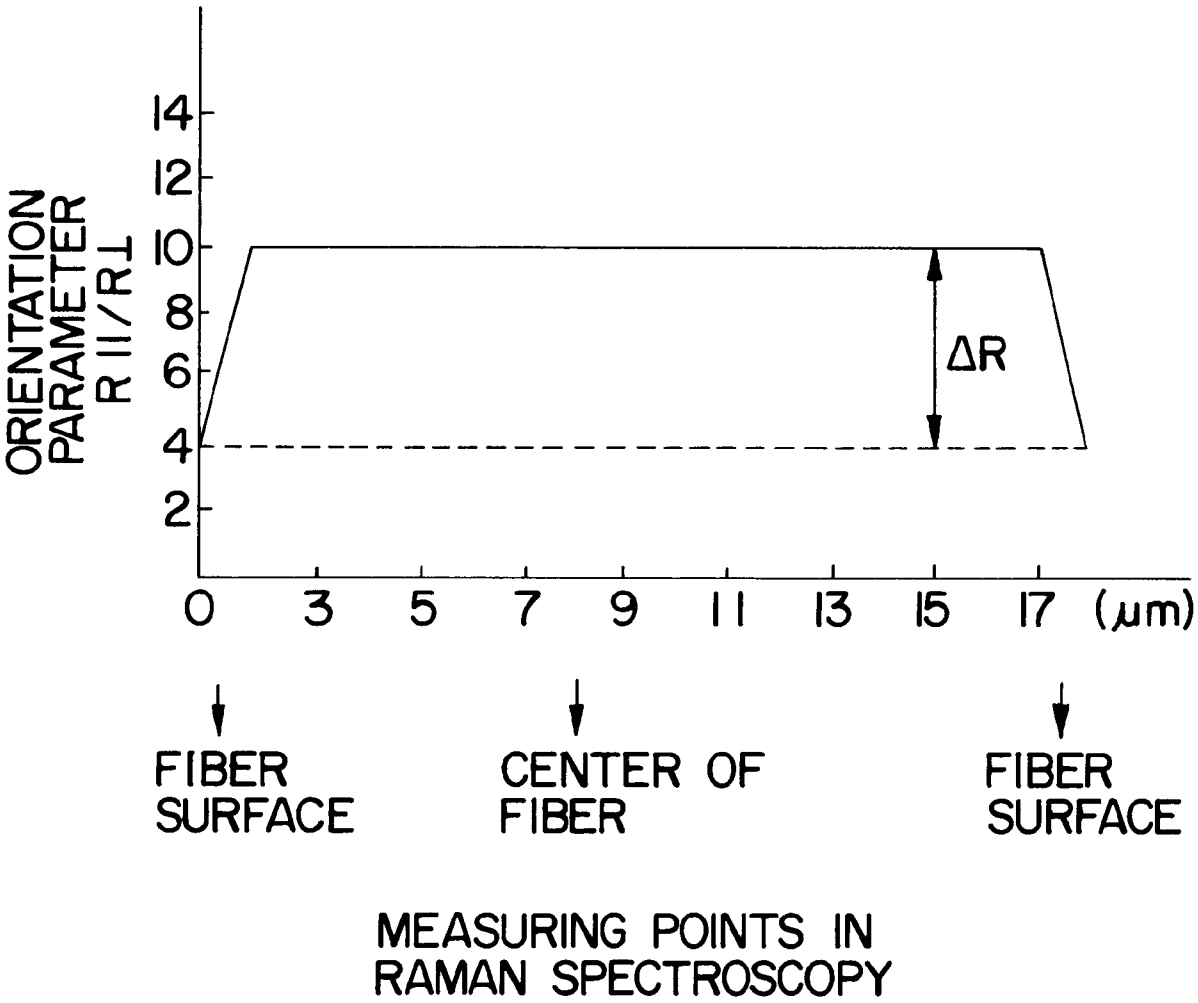
FIG. 1 is a diagram of the orientation parameter in the present invention.

FIG. 1 schematically illustrates the fact that the difference in the orientation parameter $\Delta R$ between the orientation parameter of a low orientation domain in a surface layer and the orientation parameter of a high orientation domain in an intermediate layer and core portion in a fiber is, for example, 6.0 (in a range from 2.2 to 8.0). That is, FIG. 1 is a diagram obtained by plotting the values of R||/R⊥ determined for a polypropylene fiber having a diameter of 18.5 μm (fineness of 2.2 d/f). As will be seen from FIG. 1, when both ends of the line showing the value of the orientation parameter were connected with a straight line, a symmetrical trapezoid is constructed, with the center axis of the fiber being the center of the trapezoid. Since the core portion contributes to the strength of fiber and the surface portion contributes to the heat-adhesion property or melt-adhesion property of fiber in the fibers having such an orientation parameter, non-woven fabrics having an extremely high strength can be obtained without sacrifice of a good hand feeling when such fibers were processed into webs and the webs were subjected to a heat-melt-adhesion treatment. Difference in the orientation parameters is preferably 4.0 or more, but less than 8.0, and desirably 5.0 or more, but less than 8.0 in particular. When the difference in the orientation parameters is less than 2.2, the adhesion in the non-woven fabrics obtained through heat-adhesion by a point-bonding method is insufficient. On the other hand, when the difference exceeds 8.0, card passing ability of webs at the time of preparing non-woven fabrics becomes poor.

Figure 2:
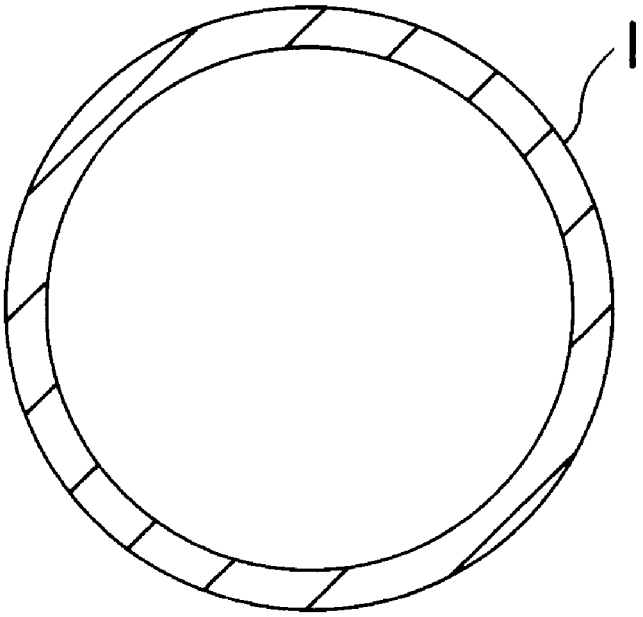
FIG. 2 shows a schematic cross-section explaining the ratio of the area of the cross-section of the surface portion having a lower orientation parameter to the area of whole cross-section of the fiber (area percentage) in the present invention.

In the present invention, the ratio of the area of the domain having an orientation parameter smaller than that of the high orientation domain by 2.2 to 8.0 to the area of the whole cross-section (transection) of the fiber (area percentage) is preferably 5% or more, but less than 40%, and more desirably 15% or more, but less than 30% in particular. Whole cross-section of such fiber is schematically shown in FIG. 2 in which the portion (1) shown by oblique lines is a domain having such a low orientation parameter, and the area percentage of the domain to the whole cross-section of the fiber is expressed by the following equation:

$$\text{Area percentage} = \frac{\text{Area of the domain having a low orientation parameter}}{\text{Area of whole cross-section of fiber}} \times 100\,(\%)$$

When the area percentage is less than 5%, adhesion of fibers when processed into a point-bonded non-woven fabric is insufficient. However, when it exceeds 40%, the card passing ability at the time of preparing non-woven fabrics and hand feeling of non-woven fabrics are unpreferably poor.

In the present invention, the term "polyolefin fiber" is intended to have the meaning of a fiber comprising a propylene homopolymer or olefin copolymer or terpolymer containing, as main component, propylene unit.

As the olefin copolymer containing, as main component, propylene unit, random copolymers of 85 or more % by weight of propylene with less than 15% by weight of ethylene, and random copolymers of 50 or more % by weight of propylene with less than 50% by weight of 1-butene can be mentioned as examples. As the terpolymer containing, as main component, propylene unit, copolymers prepared from 85 or more % by weight of propylene, less than 10% by weight of ethylene, and less than 15% by weight of 1-butene can be mentioned as examples.

As these polyolefins, ones polymerized by using either the so-called Ziegler-Natta catalyst or metallocene catalyst can be used.

Fibers of the present invention may be either single component fibers or composite fibers of a sheath/core or side-by-side structure.

Fineness of the fiber is usually 0.5 to 30 d/f, preferably 1.0 to 15 d/f, and more desirably 1.5 to 6.0 d/f. When the fineness is too small, the spinnability and the card passing ability when non-woven fabrics are prepared are poor. On the other hand, when the fineness is too large, the hand feeling of non-woven fabric becomes poor. While the oiling agent to be applied on the fiber is not specifically limited, at least one oiling agent selected from the group consisting of mineral oils, dibasic acid esters, and fatty acid esters is preferable since it has an effect particularly for improving the adhesion of fibers.

Conditions for preparing the polyolefin fiber of the present invention are not specifically restricted. However, the fibers of the present invention can usually be produced by extruding a polyolefin resin at a temperature of 320 to 350° C. to form filaments, taking up the filaments thus formed at a rate of higher than 800 m/min, and then stretching the filaments at a stretching temperature of lower than 100° C. at a stretching ratio of less than 3 times. In particular, when the extrusion temperature of the resin is higher than 323° C. but lower than 350° C., fibers of the present invention having a domain of a low orientation parameter at the area percentage described above can stably be formed.

Figure 3:
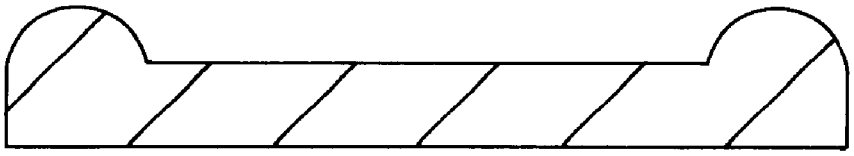
FIG. 3 shows a schematic cross-section of a fibrous structure at an embossing point in a non-woven fabric produced by using the polyolefin fibers of the present invention by a point bonding method.

In order to prepare non-woven fabrics by using the polyolefin fibers of the present invention, methods heretofore known in the public, for instance, a method of processing with an embossing roll, through air, or calender roll, or processing by sonic bonding can be applied. Particularly, a method wherein a web which was obtained, for instance, by subjecting an aggregate of the fibers described above to a carding is processed with an embossing roll or others to prepare a point-bonded non-woven fabric is most desirable. Further, it is possible to prepare a point-bonded non-woven fabric by processing a carded web withfor example, an embossing roll, after the carded web was subjected to a treatment such as a needle-punching or water-needling, as required. Also, a point-bonded non-woven fabric can be prepared by processing a web obtained by a wet paper making process or a web obtained by an air-laid process with an embossing roll or the like. When point-bonded non-woven fabrics are prepared by using the fibers of the present invention, it is preferable to select the conditions of the embossing roll so that the fibrous structures having such a concave cross-section as shown in FIG. 3 are formed at embossing points. When non-woven fabrics were prepared under the conditions wherein the cross-sectional shape of the fibrous product at embossing points becomes concave, fibers in the fabrics are adhered in a fashion of embracing each other, and thus the strength of the non-woven fabrics further increases. Since such fabrics can sufficiently bear up against the tensile stress, shearing stress, and compressive stress, the non-woven fabrics are excellent even in configurational stability. One of the significant characteristics of the present invention is that the range at which the fibers can be processed into non-woven fabrics is wide and thus the fibers can readily be processed, because the fibers are composed of a surface portion of a low orientation domain having a specific low orientation parameter as described above and an inner portion of a high orientation domain. That is, in the fibers of the present invention, the lower orientation domain on the surface portion exhibits heat-melt-adhesion property necessary for processing fibers, at a wide temperature range at the time of processing fibers into non-woven fabrics. Accordingly, the fibers in non-woven fabrics are sufficiently melt-adhered each other at their contact points. On the other hand, all of the inner portions of the fiber contribute to the strength of the fiber. As the result, the strength of non-woven fabrics to be obtained increases. Especially, when conditions for embossing with a roll under which fibrous structures having a concave cross-section are formed at melt-adhered points of fibers as described above are selected, such an advantage as described above is remarkable. Besides, since the lower orientation domain on the surface portion can be processed at low temperatures compared with the higher orientation domain in the inner portion, the hand feeling of non-woven fabrics is not deteriorated. On the other hand, since conventional polyolefin fibers have a high orientation domain both on the surface portion and the inner portion of the fiber, such an advantage that obtained by using the fibers of the present invention can not be expected.

EXAMPLE

Now, the present invention will be described in more detail with reference to Examples and Comparative Examples. However, it should be understood that the present invention is by no means restricted by such specific Examples. In each of the Examples, evaluation of various items were carried out by the methods as follows:

(1) Orientation parameter:

For measuring points of 1 $\mu$m step from one surface of a fiber through center portion to opposite surface of the fiber in a specimen prepared by cutting a sample fiber parallel to the length-wise direction of the fiber, both the relative strength (R||) of the scattered lights at a wave length of 810 $cm^{-1}$ to that of 840 $cm^{-1}$ by means of the Raman spectroscopy (method of laser Raman microprobe) at the polarization arrangement parallel to the fiber axis and the relative strength (R⊥) of the scattered of lights at a wave length of 810 $cm^{-1}$ to that of 840 $cm^{-1}$ at the polarization arrangement perpendicular to the fiber axis by means of the same spectroscopy as described above were determined. The ratio (R||/R⊥) of the two kind of the relative strengths thus obtained was assumed to be the orientation parameter, and the larger the orientation parameter is, the higher the orientation degree of the molecules is. Difference in orientation parameter and area percentage were calculated from the relation between typical measuring points in the Raman spectroscopy and orientation parameters as shown in FIG. 1.

(2) Card passing ability of fiber:

Sample fibers were carded with a roll carding machine at a rate of 20 m/min, and the fibers which satisfied all of the following three standards were graded as "excellent", and the fibers which did not satisfy at least one of the standards were graded as "poor":

① Sample fibers do not sink to the surface of a cylinder of carding machine.

② Web obtained through the carding of sample fibers do not have unevenness on its inspection with the naked eye.

③ Metsuke (weight/unit area) of any one of specimen pieces of 25 cm×25 cm square collected from ten optional spots in the web is within the range of ±15% of the average value of the metsuke of the specimen pieces.

(3) CD strength of non-woven fabric:

Web obtained with a roll carding machine was processed into a non-woven fabric having a metsuke of 20 g/$m^2$ by means of a roll heated at 130° C., and the non-woven fabric was cut to 5 cm in the direction parallel to the machine direction and to 15 cm in the direction perpendicular to the machine direction to obtain a test specimen. The specimen was tested by using a tensile tester for breaking strength under the conditions of 10 cm of gripping distance and 10 cm/min of pulling rate, and the strength thus obtained was assumed to be CD strength of non-woven fabric.

(4) Hand feeling of non-woven fabric:

Web obtained with a roll carding machine was processed into a non-woven fabric having a metsuke of 20 g/$m^2$ by means of a roll heated at a prescribed temperature (changed at intervals of 2° C.). Hand feeling of a sample non-woven fabric was judged by organic functional tests of five panelists through hand feeling as either "excellent" or "poor", and the same judgement by three or more panelists was assumed to be the hand feeling of non-woven fabric in conclusion.

(5) Adoptable temperature range for processing web:

Range of temperature of a heated roll in which non-woven fabrics having a CD strength of 0.6 kg/5 cm or more and an excellent hand feeling were obtained by the method described in (4) above was assumed to be the adoptable temperature range for processing webs into non-woven fabrics. For instance, when such conditions were satisfied with a heated roll at temperatures of 126 to 130° C., the adoptable temperature range for processing web is 4° C.

(6) Shape of fibrous structure at embossing point:

Shape of the cross-section of a fibrous structure at an embossing point in a non-woven fabric obtained by using a heated roll at 130° C. was observed with a scanning electron microscope (JEOL JSM-T220 produced by NIPPON ELECTRONICS CO., LTD.).

Examples 1 through 5, and Comparative Examples 1 through 3

Melt spinning was carried out by using, as polyolefin resin, a propylene homopolymer polymerized by using a Ziegler-Natta catalyst and having a MFR of 10 g/10 min at a resin temperature of from 273 to 342° C., and at a take-up speed of 1000 m/min. After the spinning, the filaments thus obtained were stretched to 1.3 times by using a heated roll at 80° C., mechanically crimped with a stuffing box, and then cut to obtain staple fibers having a fineness of 1.8 to 3.3 d/f and length of 38 mm. One of the staple fibers thus obtained was subjected to a determination for the orientation parameters for the measuring points in a surface layer, inner portion, and the surface layer at the opposite side on the same longitudinal section of fiber, at specific wave lengths by means of the Raman spectroscopy. Subsequently, the remaining fibers were subjected a carding with a roll carding machine at a rate of 20 m/min to obtain a web having a metsuke of 20 g/$m^2$. Then, the web thus obtained was processed into a non-woven fabric by using an embossing roll having a percentage of contact area of 25% heated at a prescribed temperature at a rate of 6 m/min. CD strength and hand feeling of the non-woven fabric thus obtained, and the shape of fibrous structure at an embossing point in the non-woven fabric were evaluated.

Examples 6 and 7

Example 1 was repeated with the exception that a propyolene homopolymer (MFR 14 g/10 min) polymerized by using a metallocene catalyst was used as polyolefin resin and the melt spinning was carried out at a resin temperature of from 326 to 330° C.

Examples 8 and 9, and Comparative Example 4

Example 1 was repeated with the exception that a propylene-ethylene random copolymer (MFR of pp random ① was 10 g/10 min and MFR of pp random ② was 12 g/10 min) polymerized by using a Ziegler-Natta catalyst was used as polyolefin resin and the melt spinning was carried out at a resin temperature of from 323 to 357° C.

Conditions for preparing fibers, conditions for processing webs into non-woven fabrics, and the results of evaluation are shown together in Table 1.

From Table 1, it can be understood that the polyolefin fibers of the present invention have a wide range of adoptable processing temperature when non-woven fabrics are prepared by a point bonding method. Also, it can be understood that the non-woven fabrics thus obtained have a fibrous structure in a shape of concavity at embossing points, high strength, and excellent hand feeling.

TABLE 1

| | | | Orientation parameter | | Processing of web | |
|---|---|---|---|---|---|---|
| | Fineness (d/f) | Resin[1)] | Difference in parameter | Area percentage | Card passing ability | Adoptable temperature range for processing |
| Example 1 | 1.8 | PP homo(1) | 2.4 | 8 (%) | Excellent | 6.0 (° C.) |
| Example 2 | 2.4 | PP homo(1) | 4.1 | 16 | Excellent | 8.0 |
| Example 3 | 2.3 | PP homo(1) | 6.1 | 28 | Excellent | 8.0 |
| Example 4 | 2.5 | PP homo(1) | 6.5 | 34 | Excellent | 8.0 |
| Example 5 | 3.2 | PP homo(1) | 5.7 | 29 | Excellent | 8.0 |
| Example 6 | 1.6 | PP homo(2) | 2.5 | 8 | Excellent | 8.0 |
| Example 7 | 1.8 | PP homo(2) | 4.7 | 26 | Excellent | 10.0 |
| Example 8 | 2.5 | PP random(1) | 3.8 | 24 | Excellent | 6.0 |
| Example 9 | 3.4 | PP random(2) | 4.7 | 31 | Excellent | 6.0 |
| Comparative Example 1 | 2.2 | PP homo(1) | 1.5 | 4 | Excellent | 2.0 |
| Comparative Example 2 | 3.3 | PP homo(1) | 1.3 | 3 | Excellent | 2.0 |
| Comparative Example 3 | 2.6 | PP homo(1) | 1.9 | 4 | Excellent | 2.0 |
| Comparative Example 4 | 2.8 | PP random(1) | 8.3 | 41 | Poor | 4.0 |

| | Performance of non-woven fabric (roll temp. 130° C.) | | | Conditions for preparing fiber | |
|---|---|---|---|---|---|
| | CD strength | Hand feeling | Shape[2)] | Resin temp. | Oiling agent[3)] |
| Example 1 | 0.6 (Kg/5 cm) | Excellent | Concavity | 321 (° C.) | Oiling agent(1) |
| Example 2 | 0.8 | Excellent | Concavity | 323 | Oiling agent(1) |
| Example 3 | 0.9 | Excellent | Concavity | 331 | Oiling agent(1) |
| Example 4 | 1.1 | Excellent | Concavity | 332 | Oiling agent(2) |
| Example 5 | 1.0 | Excellent | Concavity | 342 | Oiling agent(1) |
| Example 6 | 1.1 | Excellent | Concavity | 326 | Oiling agent(1) |
| Example 7 | 1.3 | Excellent | Concavity | 330 | Oiling agent(1) |
| Example 8 | 1.2 | Excellent | Concavity | 323 | Oiling agent(1) |
| Example 9 | 1.3 | Excellent | Concavity | 325 | Oiling agent(1) |
| Comparative Example 1 | 0.3 | Excellent | Flat | 273 | Oiling agent(1) |
| Comparative Example 2 | 0.4 | Excellent | Flat | 302 | Oiling agent(2) |
| Comparative Example 3 | 0.3 | Excellent | Flat | 311 | Oiling agent(1) |
| Comparative Example 4 | 1.2 | Poor | Concavity | 357 | Oiling agent(1) |

Note:
[1)]Resin:
PP homo(1) : Polypropylene Homopolymer; MFR = 10 g/10 min (Ziegler-Natta catalyst)
PP homo(2) : Polypropylene Homopolymer; MFR = 14 g/10 min (Metallocene catalyst)
PP random(1) m: Polypropylene Random copolymer; MFR = 12 g/10 min; (Ziegler-Natta catalyst) Ethylene content 0.7 wt %
PP random(2) : Polypropylene Random copolymer; MFR = 10 g/10 min; (Ziegler-Natta catalyst) Ethylene content 2.0 wt %
[2)]Shape: Shape of cross-section of fibrous structure in non-woven fabric at embossing point
[3)]Oiling agent:
Oiling agent(1) : Composition comprising 50 wt % of polyethyleneglycol dilaurate and 50 wt % of polyethyleneglycol monolaurate
Oiling agent(2) : Composition comprising 10 wt % of sodium stearyl sulfonate, 35 wt % of glycerin tristearate, 20 wt % of dioctyl adipate, and 35 wt % of polyethyleneglycol distearate

INDUSTRIAL APPLICABILITY

Non-woven fabrics having a high strength and excellent hand feeling can be obtained from the polyolefin fibers of the present invention. Further, non-woven fabrics having stabilized qualities can be produced from the fibers of the present invention, since the fibers have a wide range of adoptable processing temperature when they are processed into non-woven fabrics by a point bonding method.

We claim:

1. A polyolefin fiber comprising a surface portion of a low-orientation domain and an inner portion of a high-orientation domain, wherein the low-orientation domain has an orientation parameter, as measured by Raman spectroscopy, smaller than that of the high-orientation domain by 2.2 or more, but less than 8.0, and the fiber has a ratio of the area of the cross-section of the low-orientation domain to the area of whole cross-section of the fiber (area percentage) of 5%or more, but less than 40%.

2. The polyolefin fiber according to claim 1 wherein the polyolefin fiber is a polypropylene fiber.

3. The polyolefin fiber according to claim 1 wherein the polypropylene of the polyolefin fiber is a polypropylene polymerized by using a Ziegler-Natta catalyst or a metallocene catalyst.

4. A non-woven fabric produced by heat-melt-adhering an agglomerate of the polyolefin fiber, defined in claim 1, by a point bonding method.

5. The polyolefin fiber according to claim 2 wherein the polypropylene of the polyolefin fiber is a polypropylene polymerized by using a Ziegler-Natta catalyst or a metallocene catalyst.

6. A non-woven fabric produced by heat-melt-adhering an agglomerate of the polyolefin fiber, defined in claim 2, by a point bonding method.

7. A non-woven fabric produced by heat-melt-adhering an agglomerate of the polyolefin fiber, defined in claim 3, by a point bonding method.

* * * * *